US005627551A

United States Patent [19]

Tsuru et al.

[11] Patent Number: 5,627,551

[45] Date of Patent: *May 6, 1997

[54] ANTENNAS FOR SURFACE MOUNTING AND METHOD OF ADJUSTING FREQUENCY THEREOF

[75] Inventors: Teruhisa Tsuru; Toshifumi Oida, both of Kyoto, Japan

[73] Assignee: Murata Manufacturing Co., Ltd., Japan

[ * ] Notice: The term of this patent shall not extend beyond the expiration date of Pat. No. 5,570,802.

[21] Appl. No.: 501,459

[22] Filed: Jul. 12, 1995

[30] Foreign Application Priority Data

Aug. 5, 1994 [JP] Japan ..... 6-184934

[51] Int. Cl.[6] ..... H01Q 1/38

[52] U.S. Cl. ..... 343/700 MS; 343/702; 343/846; 343/849

[58] Field of Search ..... 343/700 MS, 702, 343/829, 846, 849

[56] References Cited

U.S. PATENT DOCUMENTS 5,307,556 5/1994 Kido ..... 29/600

5,510,802 4/1996 Tsuru et al. ..... 343/700 MS

FOREIGN PATENT DOCUMENTS 0621653 4/1993 European Pat. Off. ..... H01Q 1/27

61-210707 3/1985 Japan ..... H01Q 13/08

*Primary Examiner*—Donald T. Hajec

*Assistant Examiner*—Tho Phan

*Attorney, Agent, or Firm*—Majestic, Parsons, Siebert & Hsue

[57] ABSTRACT

An antenna adapted for surface mounting has a dielectric substrate on which are attached at least one primary grounding electrode and a connector electrode which together serve as a capacitor, at least one secondary grounding electrode formed adjacent to but insulated from the connector electrode, and a radiative member disposed thereover for emitting electromagnetic radiation. The resonant frequency of this antenna can be adjusted by trimming either its connector electrode or one of the secondary grounding electrode.

7 Claims, 3 Drawing Sheets

ANTENNAS FOR SURFACE MOUNTING AND METHOD OF ADJUSTING FREQUENCY THEREOF

BACKGROUND OF THE INVENTION

This invention relates to surface-mountable antennas usable in mobile communication apparatus and a method of adjusting the resonant frequency of such an antenna.

As an example of prior art antennas adapted for surface mounting, K. Fujimoto, A. Henderson, K. Hirasawa and J. R. James disclosed (in "Small Antennas" published by Research Studies Press, Ltd., England) an inverted-F antenna 71 which, as shown in FIG. 5, has a rectangular metallic plate 72 serving as a radiation emitter, a grounding terminal 73 formed by bending perpendicularly from one side edge of the metallic plate 72, and a power feed terminal 74 formed similarly by bending perpendicularly from another side edge of the metallic plate 72. An inverted-F antenna, thus structured, can be mounted to a circuit board of a known kind by inserting its grounding and power feed terminals into throughholes, many of which are usually provided to the circuit board.

Such a prior art antenna, however, could not be surface-mounted to a printed circuit board, unless throughholes are specifically provided for having the grounding and power feed terminals inserted thereinto. Moreover, adjustments of resonant frequency of such a prior art antenna were difficult because it had to be done by trimming the metallic plate 72 which is a main component of the antenna.

SUMMARY OF THE INVENTION

It is therefore an object of this invention in view of the above to provide an antenna which can be surface-mounted easily, for example, to a printed circuit board.

It is another object of this invention to provide such a surface-mountable antenna, of which the resonant frequency can be adjusted easily.

A surface-mountable antenna embodying the invention, with which the above and other objects can be accomplished, may be characterized as comprising a dielectric substrate, at least one primary grounding electrode formed on a side surface or on the bottom surface of the dielectric substrate, a connector electrode formed at least on one side surface of the dielectric substrate such that the primary grounding electrode and the connector electrode together serve as a capacitor, at least one secondary grounding electrode formed adjacent to but insulated from the connector electrode such that the secondary grounding electrode and the connector electrode together serve as another capacitor, and a radiative member disposed on the dielectric substrate. The radiative member has a principal surface, a first holder and a second holder, the first and second holders extending from the principal surface and supporting the dielectric substrate therebetween. The first holder has a power feed electrode and a grounding terminal formed at one end thereof, and the second holder is connected to the connector electrode on the dielectric substrate. The resonant frequency of this antenna is adjusted by trimming either the connector electrode or either of the secondary grounding electrodes.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
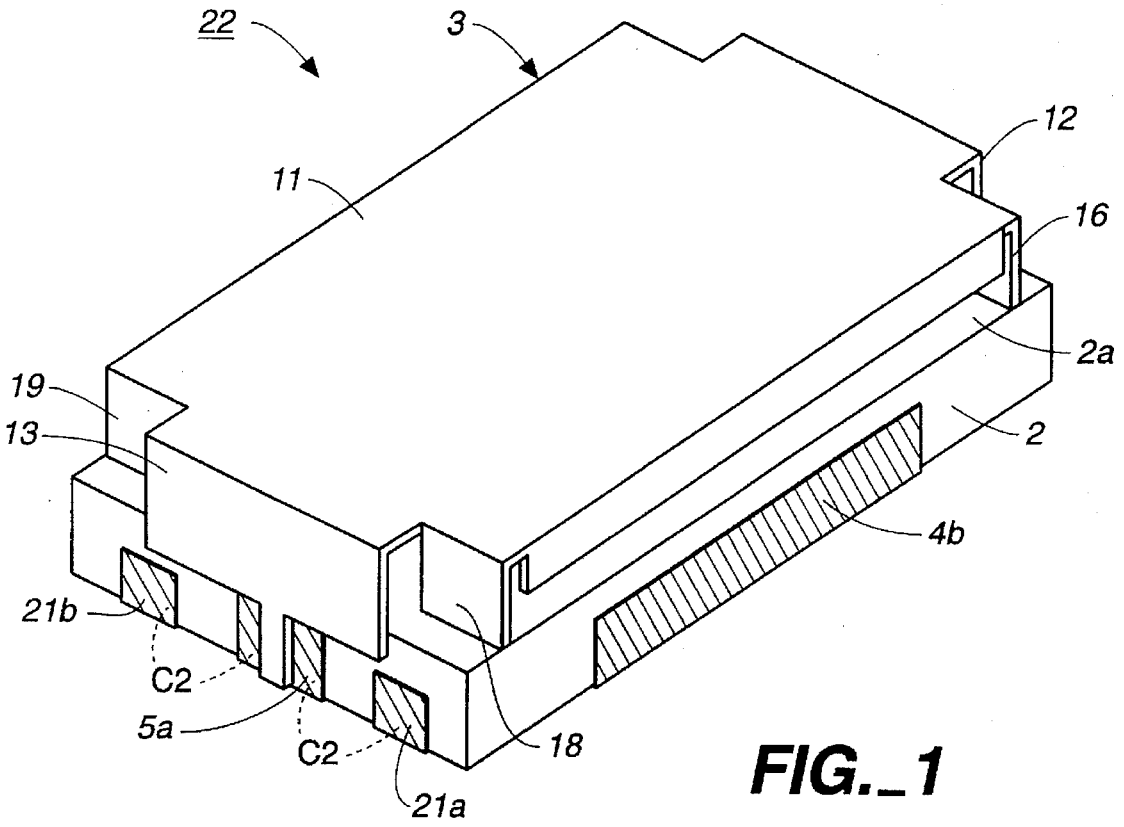
FIG. 1 is a diagonal external view of a surface-mountable antenna embodying the invention.
Figure 2:
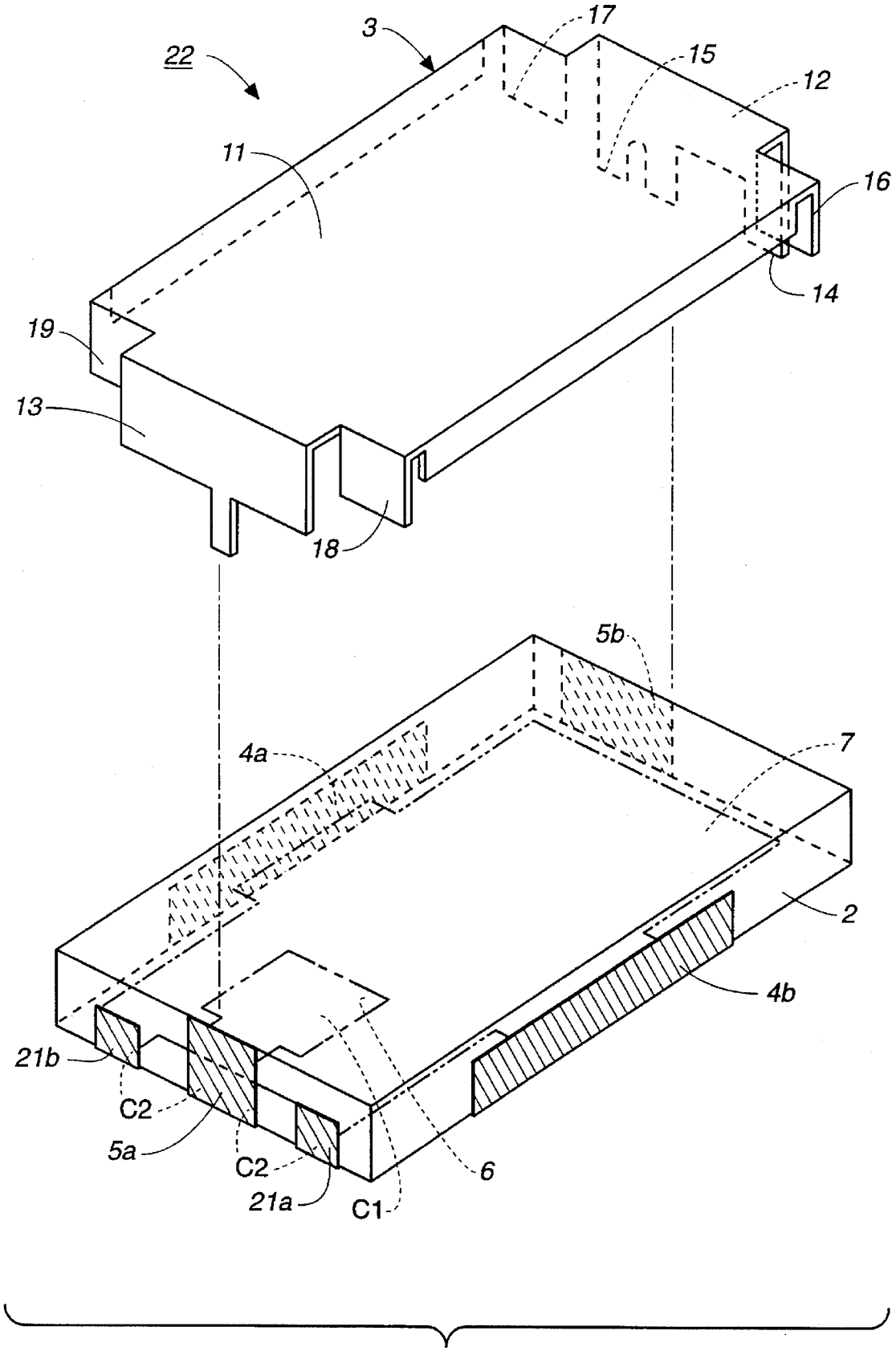
FIG. 2 is an exploded diagonal view of the antenna of FIG. 1.

As shown in FIGS. 1 and 2, a surface-mountable antenna 22, serving as an example embodying the present invention, may be characterized as comprising a substantially rectangular dielectric substrate 2 and a radiative member 3 fastened to side surfaces of the dielectric substrate 2 so as to leave a space 2*a*thereabove. The dielectric substrate 2 is formed by piling in layers a plurality of dielectric sheets made of a ceramic or resin material, having primary grounding electrodes 4*a* and 4*b* formed on side surfaces along its longer sides, connector electrodes 5*a* and 5*b* formed on side surfaces along its shorter sides, and secondary grounding electrodes 21*a* and 21*b* on opposite sides of, and insulated from, the connector electrode 5*a* on one of the side surfaces of the dielectric substrate 2. Inside the dielectric substrate 2, a planar conductor pattern 6 (referred to as the capacitor pattern) connected to the connector electrode 5*a* is formed nearer its upper surface and another planar conductor pattern 7 (referred to as the grounding pattern) connected to the primary and secondary grounding electrodes 4*a*, 4*b*, 21*a* and 21*b* is formed nearer its lower surface and parallel to the capacitor pattern 6 such that a capacitor $C_1$ is formed between the capacitor and grounding patterns 6 and 7 and another capacitor $C_2$ between the connector electrode 5*a* and the secondary grounding electrodes 21*a* and 21*b*. The radiative member 3 is made of a material with low conductor loss such as copper or a copper alloy and has a radiative part 11 having a rectangular planar shape and a pair of holders 12 and 13 formed by folding pieces protruding from the shorter sides of the radiative part 11 downward so as to be facing each other (as shown in FIG. 2). A power feed terminal 14 and a grounding terminal 15 are formed on the tip of the holder 12. Spacers 16–19 are also formed by bending small pieces protruding from the shorter sides of the radiative part 11 downward on both sides of the holders 12 and 13. The surface-mountable antenna 22 is formed by inserting the dielectric substrate 2 into the radiative member 3 such that the dielectric substrate 2 is sandwiched between the holders 12 and 13 and the spacers 16–19 touch the upper surface of the dielectric substrate 2 to make certain that a space 2*a* with a specified height is left between the lower surface of the radiative part 11 and the upper surface of the dielectric substrate 2. Thereafter, the connector electrodes 5*a* and 5*b* of the dielectric substrate 2 are soldered respectively to the holders 13 and 12 of the radiative member 3 to complete the antenna 22. The holder 13 is formed with a thin tip section so as to contact only a central portion of the connector electrode 5*a*, as shown in FIG. 1. Such an antenna 22 is adapted to be surface-mounted to a printed circuit board (not shown) having a wiring pattern thereon by soldering the power feed terminal 14 and the grounding terminals 4*a* and 4*b* to the wiring pattern.

Figure 3:
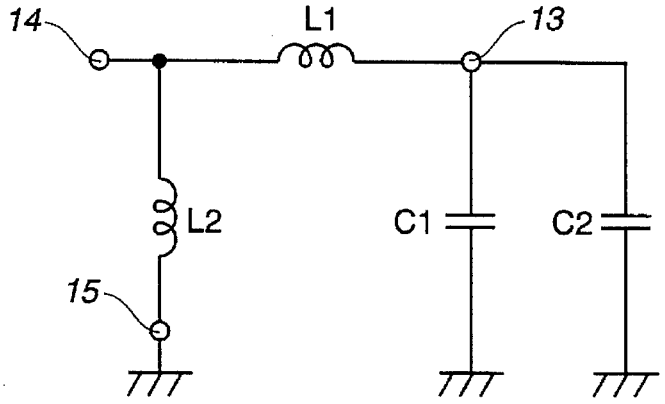
FIG. 3 is an equivalent circuit diagram of the antenna of FIG. 1.

The surface-mountable antenna 22, thus structured, has distributed capacitance $C_2$ formed between the connector electrode 5*a* and each of the secondary grounding electrodes 21*a* and 21*b* between which it is sandwiched. Its equivalent circuit diagram, therefore, includes distributed capacitance $C_2$ connected in parallel with the capacitor $C_1$, as shown in FIG. 3. This parallel connection (of $C_1$ and $C_2$) is connected in series with distributed inductance $L_1$ of the radiative part 11, and this series connection is connected in parallel with distributed inductance $L_2$ between the power feed terminal 14 and the grounding terminal 15 of the radiative member 3. Thus, the resonant frequency $f_0$ of this antenna 22 is expressed by:

$$f_0=1/(2\pi\{(C_1+C_2)(L_1+L_2)\}^{1/2}).$$

The resonant frequency $f_0$ of the antenna 22 can be adjusted by trimming the connector electrode 5*a* or the grounding electrode $21_a$ or 21*b* to vary the distributed capacitance $C_2$.

Figure 4:
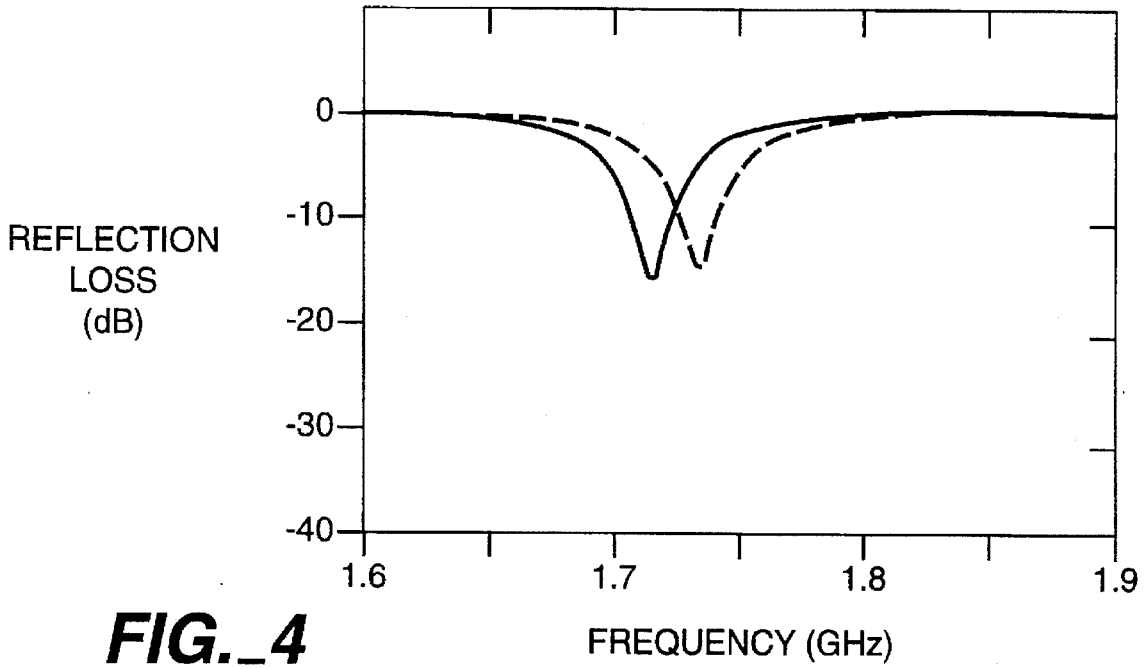
FIG. 4. is a reflection loss characteristic of the antenna of FIG. 1.
Figure 5:
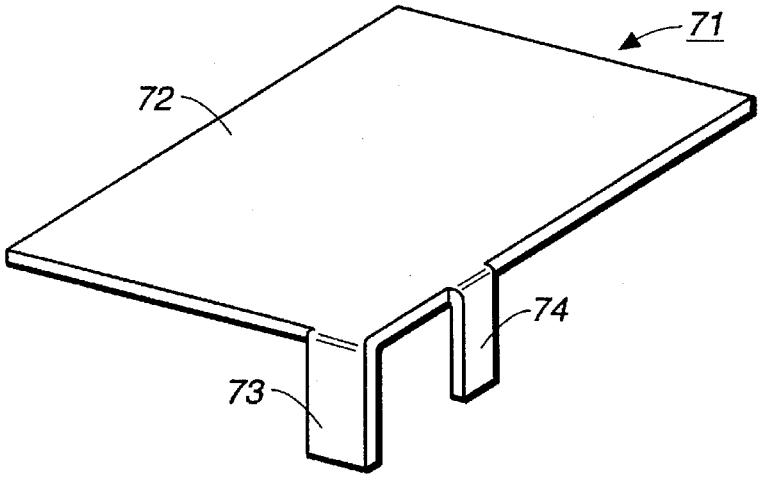
FIG. 5 (PRIOR ART)
FIG. 5 is a diagonal external view of a prior art antenna.

FIG. 4 shows the change in the resonant frequency (in terms of the reflection loss characteristic) of an antenna structured as described above, with length 10 mm, width 6.3 mm and height 4 mm, depending on presence or absence of the secondary grounding electrodes 21*a* and 21*b*. The broken line is for an antenna without the secondary grounding electrodes 21*a* and 22*b* formed thereon, while the solid line is for an antenna with secondary electrodes 21*a* and 21*b* present. FIG. 4 shows that the resonant frequency is 1.732 GHz if the secondary grounding electrodes 21*a* and 21*b* are not present but it decreases by as much as 19 MHz to 1.713 GHz if the secondary grounding electrodes 21*a* and 21*b* are present.

Although the present invention has been described above by way of only one example with reference to FIGS. 1–4, this example is not intended to limit the scope of the invention. Many variations and modifications are possible within the scope of the invention. For example, there may be only one secondary grounding electrode 21*a* or 21*b*, and the secondary grounding electrode, or electrodes, may be connected, not necessarily to the grounding pattern 7, but also, or instead of, the grounding electrode 4*a* or 4*b* through the bottom or side surface of the dielectric substrate 2. Alternatively, the secondary grounding electrodes 21*a* and 21*b* may be formed independently and connected to a grounding pattern on a printed circuit board (not shown) when the antenna 22 is mounted to it. The secondary grounding electrodes 21*a* and 21*b* may be formed on the bottom surface of the dielectric substrate 2.

Another advantage of the antenna 22 is that, since it has both distributed inductance $L_1$ of the radiative part 11 of the member 3 and distributed inductance $L_2$ between the power feed terminal 14 and the grounding terminal 15, it is possible to change the distance between the power feed and grounding terminals 14 and 15 to change the distributed inductance $L_2$ to thereby adjust the ratio between $L_1$ and $L_2$. The impedance of the antenna 22 can thus be changed and matched to the impedance of an external circuit. Since a metallic material is used for the radiative part 11 for radiating electromagnetic waves, the resistance of the antenna 22 is reduced and its thermal capacity is increased. This reduces its Joule heat and the gain is increased.

In summary, an antenna according to this invention is easily surface-mountable because its grounding and power feed terminals are formed on the side and/or bottom surface and hence the main surface of a layered structure opposite to the radiation emitting surface can be used for the surface mounting. Moreover, distributed capacitance is formed according to this invention parallel to the capacitance between the connector electrode on a side surface of the dielectric substrate and a secondary grounding electrode. Thus, the resonant frequency of the antenna can be adjusted easily by trimming the connector electrode or the secondary grounding electrode.

What is claimed is:

1. An antenna for surface mounting, comprising:

a dielectric substrate having a top surface, a bottom surface and side surfaces therebetween;

at least one primary grounding electrode on said dielectric substrate;

a connector electrode on said dielectric substrate, said primary grounding electrode and said connector electrode together serving as a capacitor;

at least one secondary grounding electrode formed adjacent to but insulated from said connector electrode, said secondary grounding electrode and said connector electrode together serving as a second capacitor for adjusting the resonance frequency of said antenna; and a radiative member disposed on said dielectric substrate, said radiative member having a principal surface, a first holder and a second holder, said first and second holders extending from said principal surface and supporting said dielectric substrate therebetween, said first holder having a power feed electrode and a grounding terminal formed at one end thereof, and said second holder being connected to said connector electrode on said dielectric substrate.

2. The antenna of claim 1 wherein said connector electrode is formed on at least one of said side surfaces of said dielectric substrate.

3. The antenna of claim 2 wherein said primary grounding electrode is formed on another of said side surfaces or said bottom surface.

4. The antenna of claim 1 wherein said primary grounding electrode is formed on one of said side surfaces or said bottom surface.

5. The antenna of claim 1 wherein said radiative member comprises a low conductor loss material selected from the group consisting of copper and copper alloys.

6. A method of adjusting resonance frequency of the antenna according to claim 5, said method comprising the step of trimming said connector electrode.

7. A method of adjusting resonance frequency of the antenna according to claim 1, said method comprising the step of trimming said connector electrode.

* * * * *

UNITED STATES PATENT AND TRADEMARK OFFICE

CERTIFICATE OF CORRECTION

PATENT NO. : 5,627,551

DATED : May 6, 1997

INVENTOR(S) : Teruhisa Tsuru et al.

It is certified that error appears in the above-indentified patent and that said Letters Patent is hereby corrected as shown below:

On the Title Page [*] Notice:
replace "5,570,802" with:

--5,510,802--

Signed and Sealed this

Ninth Day of December, 1997

*Attest:*

*Attesting Officer*

BRUCE LEHMAN

*Commissioner of Patents and Trademarks*